United States Patent [19]

Arthur et al.

[11] Patent Number: 5,049,898

[45] Date of Patent: Sep. 17, 1991

[54] PRINTHEAD HAVING MEMORY ELEMENT

[75] Inventors: Alan R. Arthur, Salem; Robert R. Beeson, Corvallis, both of Oreg.

[73] Assignee: Hewlett-Packard Company, Palo Alto, Calif.

[21] Appl. No.: 554,102

[22] Filed: Jul. 13, 1990

Related U.S. Application Data

[63] Continuation of Ser. No. 326,121, Mar. 20, 1989, abandoned.

[51] Int. Cl.[5] ..... B41J 2/01

[52] U.S. Cl. ..... 346/1.1; 346/139 C; 346/140 R; 400/703

[58] Field of Search ..... 346/140, 139 C, 1.1; 400/126, 175, 703, 705.1; 360/1

[56] References Cited

U.S. PATENT DOCUMENTS

| | | | |
|---|---|---|---|
| 4,121,222 | 10/1978 | Diebold | 346/75 |
| 4,135,245 | 1/1979 | Kemplin et al. | 364/520 |
| 4,328,504 | 5/1982 | Weber | 346/140 X |
| 4,386,862 | 6/1983 | Kittel | 400/175 X |
| 4,413,264 | 11/1983 | Cruz-Uribe | 346/75 X |
| 4,518,272 | 5/1985 | George | 400/705.1 |
| 4,577,200 | 3/1986 | Rix | 346/140 |
| 4,666,290 | 5/1987 | Yoshiura | 355/14 D |
| 4,675,696 | 6/1987 | Suzuki | 346/140 X |
| 4,709,245 | 11/1987 | Piatt | 346/140 R |
| 4,712,172 | 12/1987 | Kiyohara | 346/140 X |
| 4,716,421 | 12/1987 | Ozawa | 346/140 |
| 4,755,836 | 7/1988 | Ta et al. | 346/140 R |
| 4,779,104 | 10/1988 | Lawrence et al. | 346/139 R |
| 4,872,027 | 10/1989 | Buskirk | 346/140 |

OTHER PUBLICATIONS

Lonis, Robert A; Storage of Operating Parameters in Memory Internal with Printhead; Xerox Disc. Journal, V8, N6, N/D, 1983, p. 503.

*Primary Examiner*—Joseph W. Hartary

[57] ABSTRACT

A disposable printing assembly includes a memory element in which data characterizing the assembly can be stored. This data can characterize the identity of the assembly, or one or more of its operational characteristics. Such operational characteristics for an illustrative ink jet printhead assembly may include the color of ink in the printhead, its amount, or the position of the ink jet orifice plate on the printhead body. This data can then be read from the printhead by a read/write element in a printer and can be used or displayed as desired. The datum characterizing the position of the orifice plate, for example, can be used to controllably delay certain of the firing signals provided to the printhead to compensate for any misalignment. The datum characterizing ink amount can be updated by the write head to reflect use of ink during printing and can warn the user of an impending exhaustion of ink.

13 Claims, 2 Drawing Sheets

PRINTHEAD HAVING MEMORY ELEMENT

CROSS-REFERENCE TO RELATED APPLICATION

This application is a continuation of application Ser. No. 07/326,121, filed Mar. 20, 1989, now abandoned.

FIELD OF THE INVENTION

The present invention relates to printing assemblies, such as ink jet printheads, and more particularly relates to techniques for characterizing such assemblies to the printing apparatuses with which they are used.

BACKGROUND AND SUMMARY OF THE INVENTION

In the past fifty years, ink jet printing has matured from a technical curiosity to a mainstay of office automation. Advances in recent years have permitted ink jet printers to produce print quality that rivals that of laser printers. Nonetheless, the existing state of the art has certain deficiencies.

One deficiency is in the area of color printing. The basic art of ink jet color printing is well developed. It basically entails controllably ejecting droplets of cyan, yellow, magenta and sometimes black ink from separate printheads towards the printing medium. Such printing, however, requires precise relative positioning of each individual printhead so that the ink droplets produced thereby will land on the printing medium in the desired spatial relationship with the droplets produced by the other printheads. One approach to this precise relative positioning requirement has been to fabricate some or all of the printheads into one assembly, using a single orifice plate in which all the necessary orifii are formed. Since the orifice plate is formed photolithographically, the relative positioning of the various component printheads can be achieved with a high degree of accuracy. Unfortunately, the fabrication of several printheads into one assembly renders the assembly virtually useless when the first of the ink supplies in the printhead runs dry.

Another approach to the precise relative positioning requirement is to use several discrete printheads and to optically inspect the position of the orifice plate on each printhead after it has been mounted in a printer. In one such system, shown in U.S. Pat. No. 4,709,245, the edges of each orifice plate are detected by moving each printhead past a light source and sensing changes in the reflected light. If the orifice plates have been fabricated by a process in which the edges of the plate are accurately defined, such as by photolithography, then this technique can be useful in characterizing the locations of the printing orifii in the horizontal direction. However. it provides no information about the vertical position of the orifices. Furthermore, the technique is ineffective if the edges of the orifice plate are not precisely defined, as is often the case when the plate is simply sawn from its parent die.

A related deficiency in color printers is the untimely exhaustion of ink of one color during a long and complex printing task. The printing of a complex color graphic image may take several minutes. If one of the constituent inks becomes exhausted, the task must be interrupted, the exhausted printhead replaced and the task started anew. This is a waste not only of time, but also of the ink of the other colors that was used in the aborted printing task.

Some attempts have been made at providing visual indicia to indicate when an ink jet printhead is nearing exhaustion. Exemplary are ink jet printheads with transparent ink chambers. However, manufacturing considerations often dictate that opaque materials be used.

Still another deficiency of color printing systems, at least those involving separate printheads for the constituent colors, is in the inadvertent misplacement of printheads in the printer. If the cyan ink printhead is positioned where the magenta ink printhead belongs, the resulting print will be unacceptable.

The present invention addresses these and other shortcomings of prior art ink jet printing systems by providing in association with each printhead a memory element in which data characterizing the printhead can be stored. This data can characterize the identity of the printhead, or one or more of its operational characteristics. Such operational characteristics may include the color of ink in the printhead, its amount, or the position of the orifice plate on the printhead body. This data can then be read from the printhead and used or displayed as desired. The datum characterizing the position of the orifice plate, for example, can be used to controllably advance or delay certain of the orifice firing signals to compensate for any misalignment. The datum characterizing ink color can be used to permit the printer to receive printheads of any color at any printhead receptacle. The datum characterizing ink amount can be updated to reflect use of ink during printing and can warn the user of an impending exhaustion of ink.

The foregoing and additional objects, features and advantages of the present invention will be more readily apparent from the following detailed description, which proceeds with reference to the accompanying drawings.

DETAILED DESCRIPTION

Figure 1:
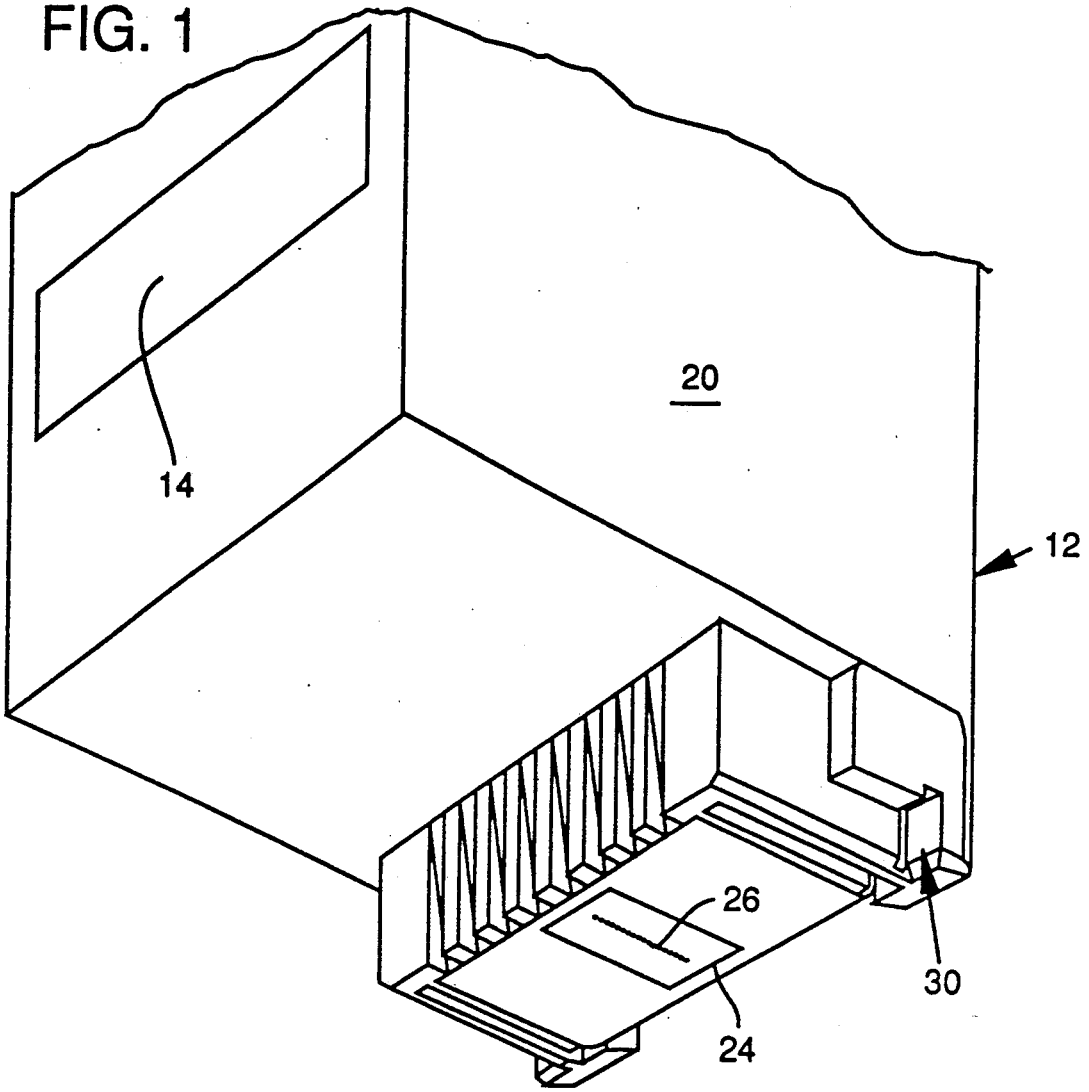
FIG. 1 is an illustration of a printhead equipped with a memory element according to one embodiment of the present invention.
Figure 2:
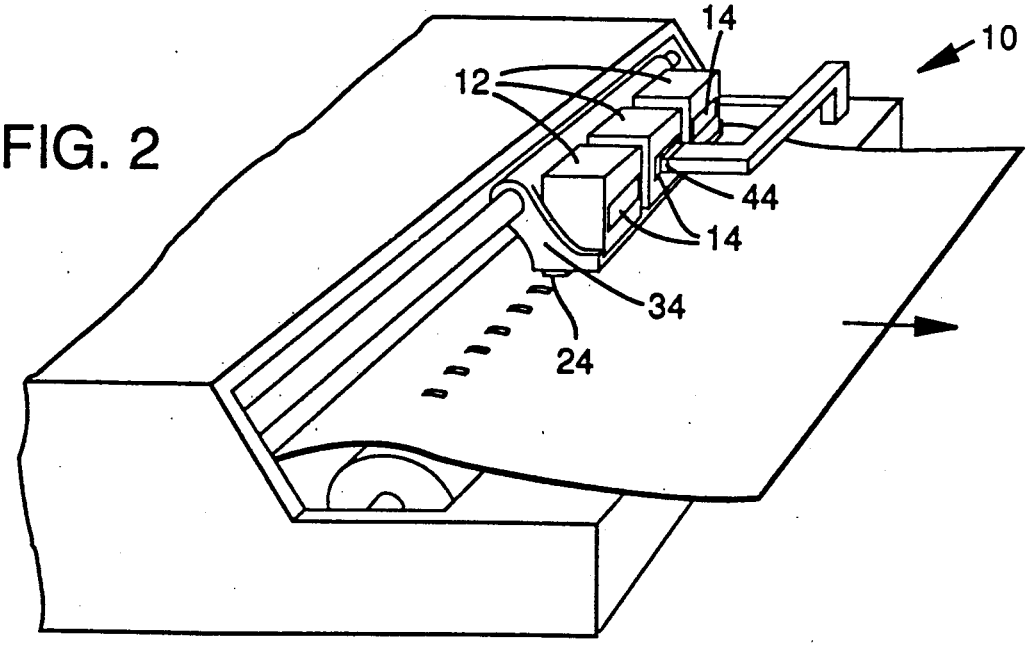
FIG. 2 is an illustration of an ink jet printer using the printhead of FIG. 1.
Figures 3, 4:
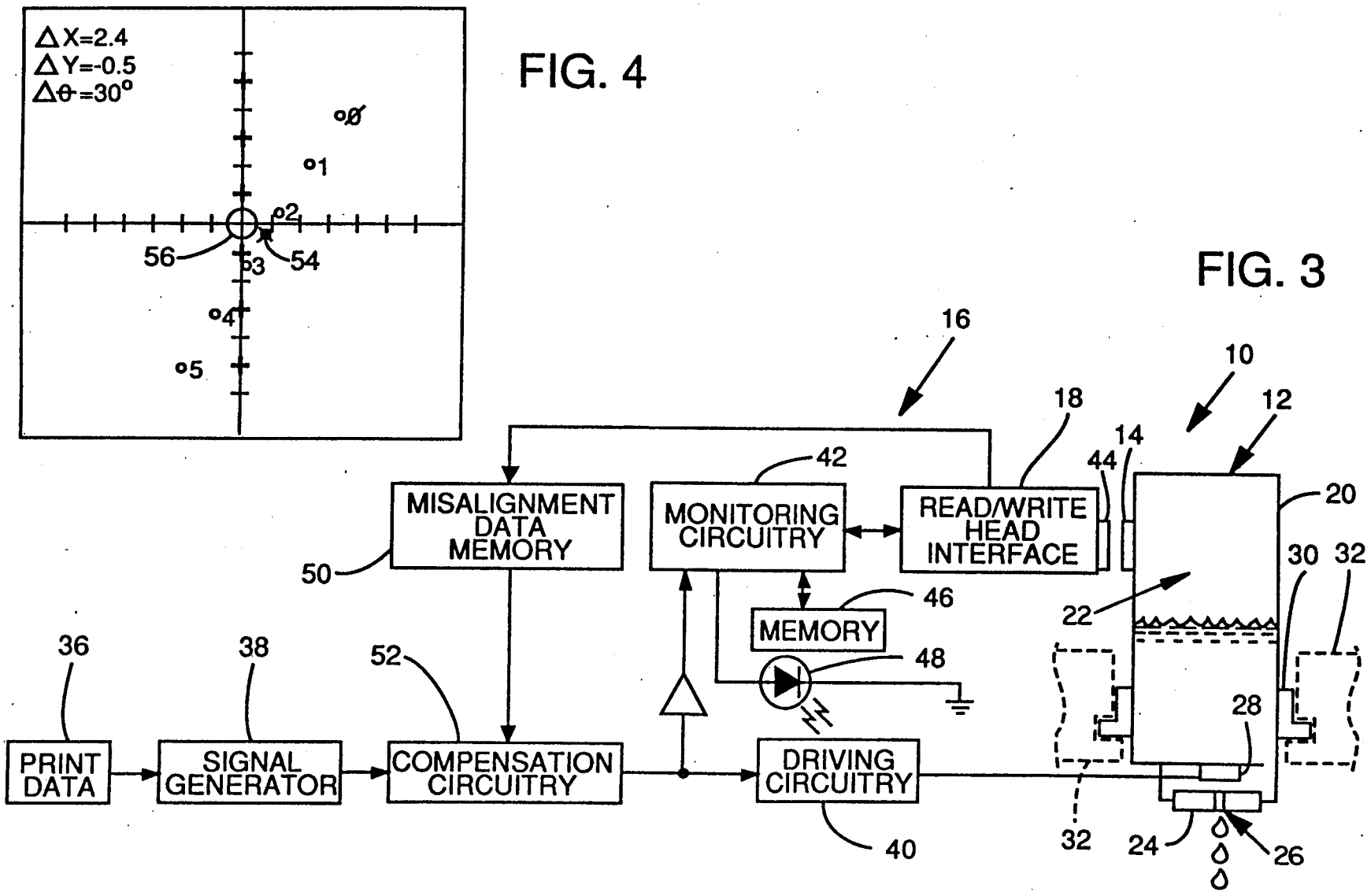
FIG. 3 is a schematic block diagram of the ink jet printer of FIG. 2.
FIG. 4 is a view of the relative misalignment of an orifice plate on a printhead as seen by an alignment inspection system.

Referring to FIGS. 1 through 3, a printing apparatus 10 according to one embodiment of the present invention includes one or more printing assemblies 12, a memory element 14 associated with each printing assembly, printer circuitry 16, and an interface 18 for interfacing the printer circuitry to the memory element.

The illustrated printing assembly 12 comprises an ink jet printhead that includes a housing 20, an ink chamber 22, an orifice plate 24 with a plurality of orifii 26 in fluid communication with the ink chamber, and a plurality of firing resistors 28 for expelling ink out of the orifii. The housing of the printhead has disposed thereon a plurality of alignment features 30 that cooperate with corresponding alignment features 32 in an associated carriage 34 to insure proper mechanical alignment of the printhead as it is carried by the carriage through the printing apparatus 10. (Suitable alignment features and associated alignment techniques are taught in U.S. Pat. No. 4,755,836, the disclosure of which is incorporated herein by reference.)

Affixed to the housing of printhead 12 is the memory element 14 which may comprise, for example, a strip of magnetic media, a semiconductor memory, or an optical medium that can be written to and read from by use of a laser. Stored in this memory is data relating to the printhead. Such information may characterize the printhead's identity (i.e. date of manufacture, fabrication site, lot number, serial number, etc.) or may characterize some operational characteristic(s) of the printhead (i.e. orifice alignment, ink color, ink level, operating frequency, dilution of the ink, etc.). This data can then be read from the printhead and used or displayed as desired.

FIG. 3 details the printer circuitry 16 used in one embodiment of the present invention. This circuitry includes a conventional data memory 36 in which data to be printed is stored, and a signal generator circuit 38 that converts this data (which may be in ASCII form or the like) into the series of timed impulses needed by the individual firing resistors 28 of the ink jet printhead 12. These signals are then conditioned by a driving circuit 40 into the voltage levels required to actually drive the firing resistors. These stages are conventional and are found in any ink jet printer.

Coupled to the output of the signal generator circuit 38 is a monitoring circuit 42 that counts the number of ink droplets the printhead is instructed to print. This count is related directly to the quantity of ink consumed by the printhead during a given printing task. The memory 14 on the printhead desirably has a datum thereon that indicates the relative quantity of ink remaining in the ink chamber. (This datum is initially loaded during the manufacturing process and is set to correspond to a full charge of ink). The count tallied by the monitoring circuit 42 can be used to periodically update this datum.

In the illustrated embodiment, this updating is accomplished by a magnetic read/write head 44 that is mounted adjacent the path of the carriage 34 so that the head 44 can read from and write to a magnetic strip memory 14 on the printhead each time the printhead passes its location. Desirably, each time the printer 10 is powered up, the printhead 12 is moved past this read/-write head 44 and the ink level datum on the printhead's magnetic strip memory 14 is read therefrom. This datum is loaded into a volatile memory 46 associated with the monitoring circuit 42. Thereafter, as the printer is used, the monitoring circuitry decrements this memory 46 to reflect the expulsion of ink from the printhead. Each time the printhead passes the read/-write head 44, this decremented value is transferred from the volatile memory 46 in the printer to the magnetic strip 14 on the printhead, updating the previous value. The printer's volatile memory 46 is thus updated continuously by its monitoring of signals provided to the printhead; the printhead's magnetic strip memory 14 is updated periodically (i.e. each time it passes the read/write head) by transfer of the datum from memory 46. When power is removed from the printer, the datum in memory 46 is lost, but the datum on the printhead's magnetic strip memory 14 remains, ready to be read the next time the printer is powered up and used again to reinitialize memory 46. If the printhead is removed from the printer and used in another printer, the datum indicating its remaining charge of ink travels with the printhead to the new printer.

Coupled to the monitoring circuit 42 is a low ink indicator 48, here illustrated to be a light emitting diode. This indicator signals to the operator when the level of ink in the printhead (as indicated by memory 46) is below a threshold value. This value may be set, for example, to correspond to the quantity of ink required to print one solid page of ink droplets. By providing warning to the user that the printhead may soon run dry, the problem of printing a complex color graphic and running out of one color of ink before completion can be avoided.

(In color printheads with multiple ink chambers, data relating to *each* ink level can be written on the magnetic strip 14. The monitoring circuitry 42 in the printer 10 can be replicated as needed for each color, or a multiplexing scheme can be adopted to permit the circuitry to process ink level data for all the colors.)

Memory 14 on the printhead may also contain data relating to the alignment of the orifice plate 24 on the printhead body 20. As noted, orifice plates are photolithographically produced to create printing orifii of precise dimension and spacing. However, the process of mounting an orifice plate at a desired location on a printhead body cannot be as precise. To minimize the degradation in printing that misalignment of the orifice plate on the printhead body might cause, data characterizing the misalignment can be stored on the magnetic media 14 and can be used to precompensate the firing pulses provided to the printhead. Data characterizing the misalignment of the orifice plate on the printhead body can be acquired by various techniques, such as by eddy current sensing, mechanical probing, or by optical inspection, either by a human or by an automated vision system.

FIG. 4 shows a grossly exaggerated view of the misalignment of an orifice plate on the body of a printhead as it might be seen by a vision system. The orifice plate on the printhead being inspected is displayed on a video screen. Superimposed on this image is a measurement graticule and a series of "+"s indicating the orifice plate's desired alignment. The orifice plate misalignment can be characterized in a number of ways. Exemplary is the X, Y offset of an optical target 54 formed at the center of the orifice array relative to a reference datum 56 indicating the desired orifice plate orientation. An additional characterizing datum is the angular offset. In the illustrated view, the X offset is 2.4 mils, the Y offset is −0.5 mils, and the angular offset is 30 degrees. This data can either be gathered by a manual operator measuring the alignment from the image on the screen, or can be acquired automatically by a computer associated with the vision system. In either event, the data is stored on the printhead's magnetic strip 14 and is available to the printer in which the printhead is used when the strip is read by the read/write head 44 on power up.

The alignment data read from the printhead is stored in the printer 10 in a memory 50 associated with a compensation circuit 52. Compensation circuit 52 changes the relative timing of the firing signals provided to the various orifii in order to minimize the printing errors caused by their spatial misalignment. In an exemplary compensation process, the leading-most orifice (as the printhead is moving across the page) may be assumed to be the reference orifice to which all the others are to be mathematically aligned. In FIG. 4, the leading-most orifice may be number 0 (depending on the direction the printhead is travelling). Orifice 1 adjacent thereto lags orifice 0 by a distance equal to their linear separation times sine theta. In the illustrated system, if the orifii are spaced 6.66 mils apart and the misalignment angle is 30 degrees, orifice 1 lags orifice 0 by 6.66 sine 30 degrees, or 3.33 mils. The driving signal provided to orifice 1 must thus be delayed a sufficient interval to permit that orifice to move ahead this 3.33 mils before it prints. If the carriage is moving at a rate of 5,000 mils per second, the firing signal provided thereto must be delayed 3.33/5,000 or 0.666 milliseconds.

Since the firing orifii are linearly aligned and uniformly spaced on the orifice plate, the delay from one orifice to the next progresses uniformly. That is, the delay required for orifice 2 is simply twice that required for orifice 1. The delay required for orifice 3 is three times that required for orifice 1, etc. This permits substantial economization in the compensating computations required of compensation circuit 52.

The above described compensation takes into account only the skew of the print produced by angular misalignment of the orifice plate 24 on the printhead body 20. This angular misalignment also produces a vertical compression of the print—i.e. the vertical component of the distance between the top and bottom orifii is shortened by a factor of cosine theta. Within the constraints of the fixed orifice spacing, this compression cannot be remedied. Fortunately, it is a relatively minor factor in most instances.

Additional compensation can easily be effected to correct for offset in the horizontal, or X, direction so that print from two or more orifice plates is properly superimposed. The firing signals to each printhead as a group are simply delayed (or advanced) by an additional factor to mathematically translate their printing to coincide with the reference Y axis. In the above example, the above-described correction of the angular misalignment puts print from the orifii in a vertical line positioned to the right of the Y axis at X=(2.5*6.66 sine theta+2.4), or 10.733 mils. To move this vertical line leftward so that it coincides with the Y axis and with compensated print from other orifice plates, the printing signals are delayed uniformly an additional 10.733/5,000 seconds, or 2.146 milliseconds.

The Y, or vertical misalignment from orifice plate to orifice plate is somewhat more difficult to rectify. If the vertical misalignment offset is greater than the distance between adjacent orifii, the printing signals intended for one orifice can be routed instead to whatever orifice is more nearly at the desired vertical position. For example, if the orifice plate 24 is 13.33 mils above its intended position and the inter-orifice spacing is 6.66 mils, then the printing signal originally intended for orifice 0 should instead be supplied to orifice 2; the printing signal originally intended for orifice 1 should instead be supplied to orifice 3, etc. In such situation, the printing signals intended for the extreme orifice(s) (i.e. orifii 4 and 5 in this example) will need instead to be printed during the *next* pass of the printhead across the page by orifii 0 and 1. This may be accomplished by buffering all the signals intended for orifii 4 and 5 in shift registers with as many stages as there are pixels across a page, and driving orifii 0 and 1 from the outputs of these shift registers, thereby effecting the necessary delay in printing signals.

In other embodiments, instead of buffering the print signals to the extreme orifices and printing with them during other scans of the printhead, the printhead and orifice plate can be fabricated with one or more additional orifii at each extreme end of the array. These extra orifii can be driven with the print signals shifted from the adjacent orifii, when necessary to correct for vertical misalignment. Such an approach is simpler to implement, in certain circumstances, than the buffered delay technique.

If the vertical misalignment is of a magnitude *less* than the spacing between adjacent orifii, the constraints of the fixed orifice spacing prevent compensation.

For convenience of illustration, the foregoing discussion has been illustrated with reference to a printhead having a single linear array of orifii. However, the principles described are similarly applicable to more complex printheads in which the orifii are arranged in other configurations, such as the dual column configuration employed by Hewlett-Packard Desk Jet printheads.

Presently, large investments in equipment and labor are made to insure extremely precise positioning of orifice plates on printhead bodies, only to have the results of these investments discarded when the ink runs dry. Far preferable is the technique of the present invention, which provides comparable print quality with far simpler positioning requirements.

Having described and illustrated the principles of our invention with reference to a preferred embodiment and several variations thereon, it will be apparent that the invention can be modified in arrangement and detail without departing from such principles. For example, while the invention has been illustrated with reference to an ink jet printer, it may be applied advantageously to a variety of other printing devices, such as plotters. Similarly, while the invention has been illustrated with reference to a magnetic strip memory on the printhead, other memory elements can readily be employed. If data on the memory need not be updated by the printer, then various read only memories may be employed, including optical bar coding in which operational characteristics of the printhead are encoded. Likewise, data communications between the printhead and printer need not be accomplished by read/write heads. Instead, other transmission techniques, such as optical or radio coupling, can alternatively be used. Finally, while the invention has been illustrated with reference to certain electronic circuitry (such as the monitoring circuitry) disposed in the printer, such circuitry in alternative embodiments can be provided as part of the printhead assembly itself. Similarly, correction for orifice plate misalignment can be effected by electronics that are part of the printhead. The necessary compensation delays, for example, can be loaded into a customizing EEPROM on the printhead and can control associated delay circuitry.

In view of these and the wide variety of other embodiments to which the principles of our invention can be applied, it should be recognized that the illustrated embodiments are to be considered exemplary only and not as limiting the scope of my invention. Instead, we claim as our invention all such modifications as may come within the scope and spirit of the following claims and equivalents thereto.

We claim:

1. In an ink jet printhead that is mounted for movement along a path and wherein the printhead has a housing with an ink chamber therein, a plurality of orifii in fluid communication with the ink chamber, and means for expelling ink from the ink chamber through said orifii, an improvement comprising:

memory means attached to the housing for storing a datum related to an operational characteristic of the printhead; and data transfer means mounted near the printhead path to read the datum as the printhead moves relative to the data transfer means.

2. The improvement of claim 1 in which the data transfer means is operable for writing data to the memory means as the printhead moves along the path.

3. The improvement of claim 1 in which the memory means comprises a magnetic medium affixed to the outside of said printhead housing.

4. The improvement of claim 3 in which the magnetic medium has a datum stored thereon relating to the color of ink in the chamber.

5. The improvement of claim 1 in which the magnetic medium has a datum stored therein relating to the amount of ink in the chamber.

6. The improvement of claim 1 in which the memory means has a datum stored therein relating to the relative alignment of the printhead's orifii and its housing.

7. The improvement of claim 1 in which the memory means has a datum stored therein relating to the operating frequency of the printhead.

8. The improvement of claim 1 in which the memory means has a datum stored therein relating to an attribute of the ink other than its color.

9. In an ink jet printing system having a carriage for carrying an ink jet printhead relative to a printing medium, the carriage including means for orienting the printhead's housing in a predetermined orientation in relation thereto, the printhead including a plurality of orifii and means for expelling ink therefrom in response to firing signals, an improvement method comprising the steps:

storing data related to the relative alignment of the printhead's orifii and its housing in a memory mounted to the printhead;

retrieving said alignment data from the memory; and compensating the timing of the firing signals in accordance with said alignment data to reduce the effects of any misalignment between the orifii and the printhead housing.

10. The invention of claim 9 which further includes the steps:

providing the orifii on an orifice plate bonded to the printhead's housing;

sensing the position of an alignment feature on the orifice plate; and storing data relating to said position in the memory.

11. A printer comprising:

a printhead mounted to the printer and operable for movement along a path;

a control circuit coupled to the printhead for controlling the printhead movement and for providing to the printhead operating signals that represent an operational characteristic of the printhead;

a data transfer head mounted to the printer adjacent to the path of the printhead;

a memory element for storing data, the memory element being mounted to the printhead and located to pass near the data transfer head as the printhead moves along the path, the data transfer head being controllable for transferring data to and from the memory element as the element passes the head; and a monitoring circuit connected between the printhead and the data transfer head, the monitoring circuit receiving and processing the operating signals and controlling the data transfer head to transfer to and from the memory element data that is representative of changes in the operational characteristics of the printhead.

12. The printer of claim 11 wherein the printhead contains a depletable supply of ink and wherein the operating signals represent the amount of ink contained by the printhead, the monitoring circuit controlling the data transfer head to transfer to and from the memory element data representative of the amount of ink contained by the printhead.

13. The printer of claim 12 further comprising indicator means connected to the monitoring circuit for providing an indication signal whenever the ink amount is defected below a predetermined level.

* * * * *